US006173686B1

(12) United States Patent
Nakayoshi et al.

(10) Patent No.: US 6,173,686 B1
(45) Date of Patent: Jan. 16, 2001

(54) VALVE TIMING CONTROL DEVICE

(75) Inventors: Hideki Nakayoshi; Naoki Kira; Takuya Niimi; Hidefumi Konakawa, all of Aichi-ken (JP)

(73) Assignee: Aisin Seiki Kabushiki Kaisha, Aichi-pref. (JP)

( * ) Notice: Under 35 U.S.C. 154(b), the term of this patent shall be extended for 0 days.

(21) Appl. No.: 09/162,000

(22) Filed: Sep. 29, 1998

(30) Foreign Application Priority Data

Sep. 29, 1997 (JP) ..... 9-264267
Nov. 27, 1997 (JP) ..... 9-326603
Nov. 27, 1997 (JP) ..... 9-326605

(51) Int. Cl.[7] ..... F01L 1/344
(52) U.S. Cl. ..... 123/90.17; 123/90.31
(58) Field of Search ..... 123/90.15, 90.17, 123/90.31; 74/568 R; 464/1, 2, 160

(56) References Cited

U.S. PATENT DOCUMENTS 4,858,572 8/1989 Shirai et al. ..... 123/90.15
5,832,887 * 11/1998 Adachi et al. ..... 123/90.17
5,937,810 * 8/1999 Sato et al. ..... 123/90.17
6,035,816 3/2000 Ogawa et al. ..... 123/90.17

FOREIGN PATENT DOCUMENTS 196 23 818 12/1996 (DE) .
0 777 037 6/1997 (EP) .
2302391 1/1997 (GB) .
9-60508 3/1997 (JP) .
10-47022 2/1998 (JP) .

* cited by examiner

*Primary Examiner*—Weilun Lo
(74) *Attorney, Agent, or Firm*—Reed Smith Hazel & Thomas LLP

(57) ABSTRACT

A valve timing control device comprising, a cam shaft assembled within an engine, a rotational transmitting member having a concave portion, which is mounted around the cam shaft to rotate relative thereto within a predetermined range for transmitting a rotational power from a crank pulley, vanes provided on the cam shaft, fluid chambers formed between the cam shaft and the concave portion, which are separated into advancing and delaying chambers by the vanes, a fluid supplying means for supplying fluid under pressure to a selected one of the advancing and delaying chambers, and a stopper located between a radially inner portion of a side wall of the concave portion and the vane to restrict rotate relative between the rotational transmitting member and the cam shaft.

2 Claims, 5 Drawing Sheets

VALVE TIMING CONTROL DEVICE

BACKGROUND OF THE INVENTION

FIELD OF THE INVENTION

The present invention relates to a valve timing control device and, in particular, to a valve timing control device for controlling an angular phase differential between a crank shaft of a combustion engine and a cam shaft of a combustion engine.

BACKGROUND OF THE INVENTION

A conventional valve timing control device is disclosed, for example, in U.S. Pat. No. 4,858,572. As shown in FIGS. 9 and 10, this device includes a cam shaft 204, a timing pulley 201 (rotational transmitting member), six vanes 202, six chambers and a fluid supplying means. The cam shaft 204 is integrally formed with an internal rotor 203 by a bolt 220 and a spacer 221. The cam shaft 204 is rotatably assembled with a cylinder head 214 of an internal combustion engine. The timing pulley 201 is driven by the rotational torque from a crank shaft (not shown) and mounted on the cam shaft so as to surround the internal rotor 203. Six chambers are defined between the timing pulley 201, the internal rotor 203 and a front plate 205. The front plate 205 is integrally fixed on the timing pulley 201. Each chamber is separated into an advancing chamber 209 and a delaying chamber 209*a*. A fluid supplying means include a changeover valve 215 which supplies fluid under pressure to at least a selected one of the advancing chambers 209 and the delaying chambers 209*a* so as to rotate relative between the cam shaft 204 and the timing pulley 201. When a solenoid 213 of the changeover valve 215 is not energized, a spool 218 is located (shown in FIG. 9 such that a feed port 212, as connected to an oil pump (not shown) to be driven by the internal combustion engine of the changeover valve 215 and a passage 211 are connected to each other. The passage 211 leads to one of the advancing chambers 209 or the delaying chambers 209*a*. The oil pump provides the feed port 212 with fluid under pressure. When the solenoid 213 of the changeover valve 215 is energized, the spool 218 is urged to slide to the right direction in FIG. 9 against the action of a spring 216 so that a feed port 212 and a passage 210 are connected to each other. The passage 211 leads to the other of the advancing chambers 209 or the delaying chambers 209*a*. The fluid under pressure in the advancing chambers 209 and the delaying chambers 209*a*is thereby controlled by the changeover valve so as to determine the relative position between the cam shaft 204 and the timing pulley 201.

In the above-mentioned prior art device, the timing pulley 201 has six projections 201*b*. Each projection 201*b* extends in an inward direction. The top portion of the projections 201*b* engages with the peripheral surface of the internal rotor 203. Both side walls 208 of the projection 201*b* are able to contact with the vane 202 so as to decide the relative rotational angle (Θ) between the cam shaft 204 and the timing pulley 201. The elaborate construction of the internal rotor 203, vanes 202 and the timing pulley 201 is necessary so that each relative position between the vane 202 and chamber is in the same proportion. The manufacturing cost of these parts, therefore, is expensive.

SUMMARY OF THE INENTION

Accordingly, it is an object of the present invention to provide an improved valve timing control device without the foregoing drawbacks.

In accordance with the present invention, a valve timing control device comprising a cam shaft rotatably assembled with a cylinder head of an engine, a rotational transmitting member having a concave portion which is located on the inside surface thereof, with the rotational transmitting member mounted around the peripheral surface of the cam shaft so as to rotate relative thereto within a predetermined range for transmitting a rotational power from a crank pulley, a plurality of vanes provided on the cam shaft or the rotational transmitting member, fluid chambers formed between the cam shaft and the concave portion of the rotational transmitting member and separated into advancing chambers and delaying chambers by the vanes, a fluid supplying means for supplying fluid under pressure to at least a selected one of the advancing chambers and delaying chambers and a stopper located between a top portion of a side wall of the concave portion of the rotational transmitting member and the vane so as to restrict rotation relative between the rotational transmitting member and the cam shaft.

Other objects and advantages of invention will become apparent during the following discussion of the accompanying drawings.

BRIEF DESCRIPTION OF THE DRAWINGS

The foregoing and additional features of the present invention will become more apparent from the following detailed description of preferred embodiments thereof when considered with reference to the attached drawings, in which.

and

Figure 9:
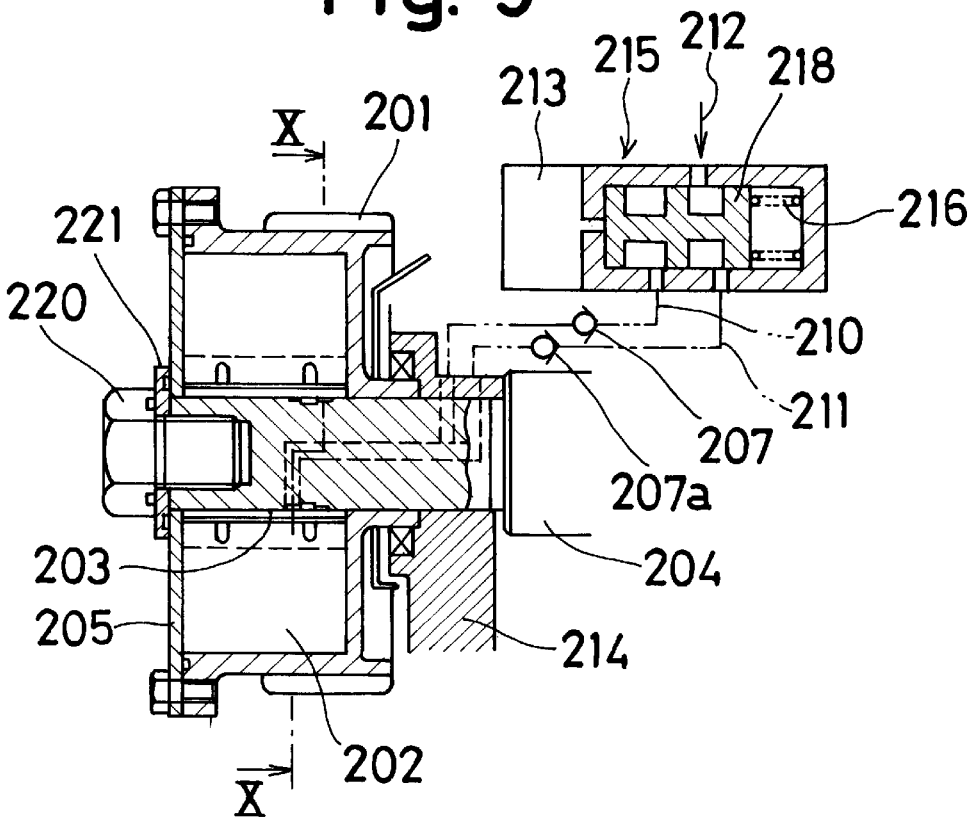
FIG. 9 is a sectional view of a conventional valve timing control device.
Figure 10:
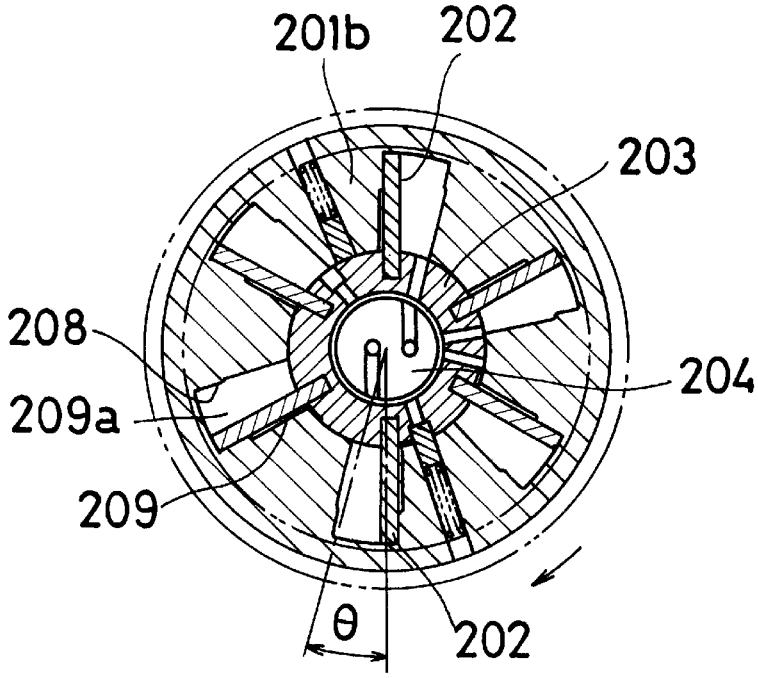

FIG. 10 is a section taken along the line X—X of FIG. 9;

DETAILED DESCRIPTION OF THE PREFERRED EMBODIMENT

A valve timing control device in accordance with preferred embodiments of the present invention will now be described with reference to the attached drawings.

Figure 1:
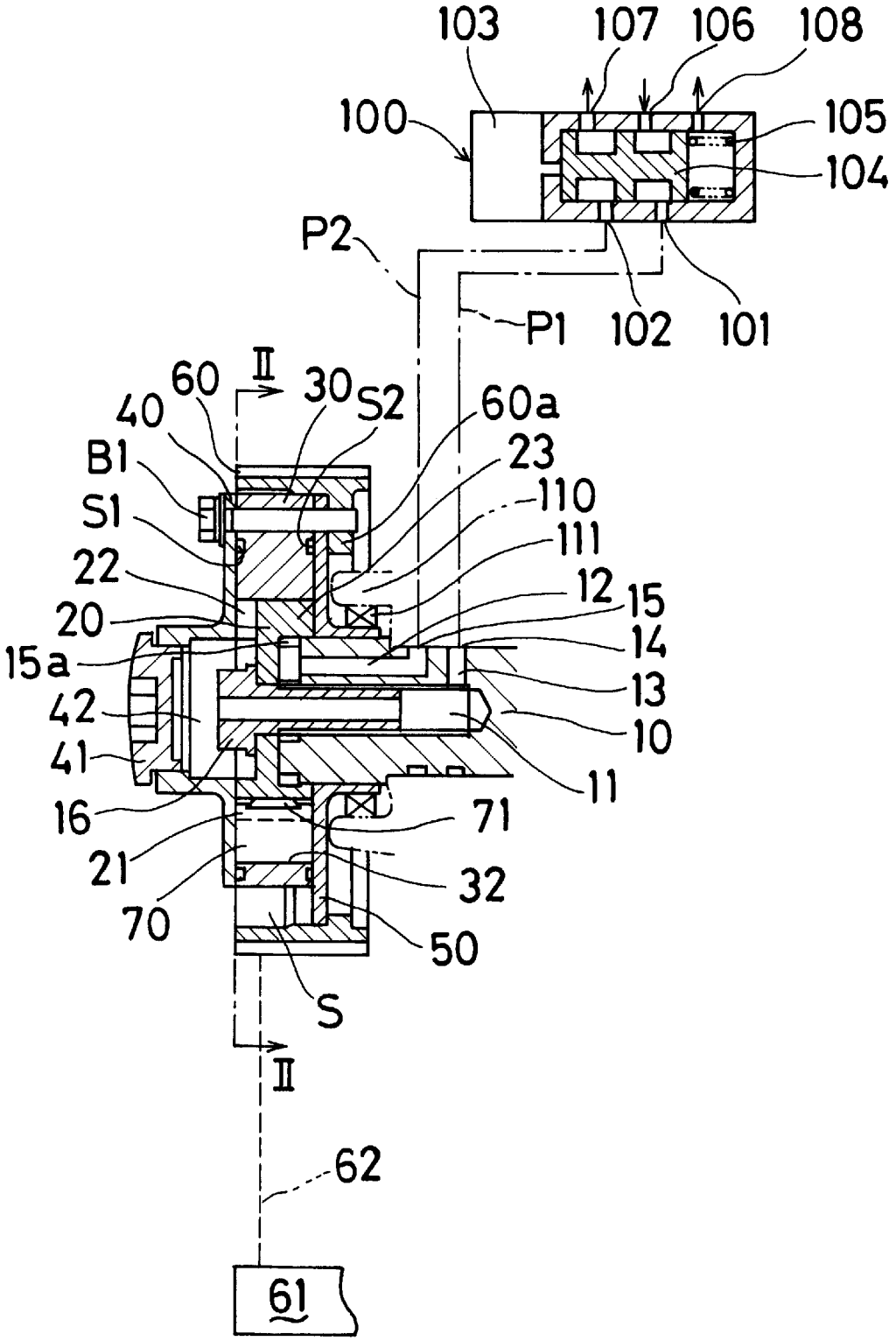
FIG. 1 is a sectional view of the preferred embodiment of a valve timing control device in accordance with the present invention.
Figure 2:
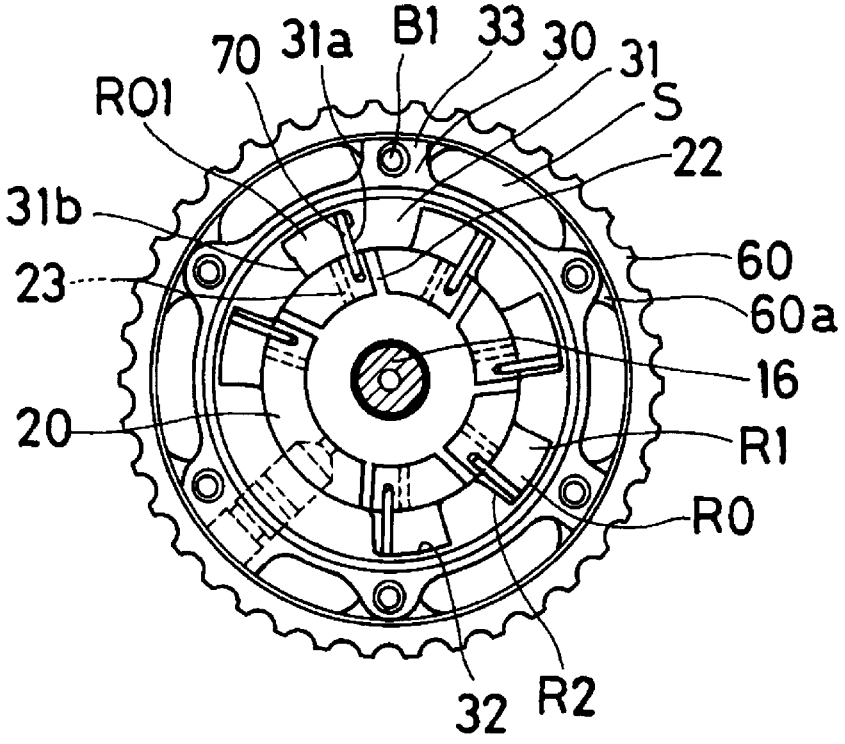
FIG. 2 is a sectional view taken along the line II—II in FIG. 1 in accordance with the present invention.

A valve timing control device according to the present invention, as is shown in FIGS. 1 and 2, is constructed so as to comprise a valve opening/closing shaft including a cam shaft 10 rotatably supported by a cylinder head 110 of an internal combustion engine, and a rotary shaft which has an internal rotor 20 integrally provided on the leading end portion of the cam shaft 10; a rotational transmitting member mounted around the rotary shaft so as to rotate relative thereto within a predetermined range and including an external rotor 30, a front plate 40, a cap 41, a rear plate 50 and a timing pulley 60; and six vanes 70 assembled with the internal rotor 20. Here, the timing pulley 60 is constructed, as is well known in the art, to transmit the rotating power to the clockwise direction of FIG. 2 from a crank pulley 61 through a timing belt 62 of a resin or a rubber shown in FIG. 1.

The cam shaft 10 is equipped with the well-known cam (not shown) for opening/closing an intake valve or an exhaust valve (not shown) and is provided therein with a delay passage 11 and an advance passage 12, which are extended in the axial direction of the cam shaft 10. The delay passage 11 is connected to a connection port 101 of a changeover valve 100 via a radial passage 13, an annular passage 14 and a connection passage P1. On the other hand, the advance passage 12 is connected to a connection port 102 of the changeover valve 100 via an annular passage 15 and a connection passage P2.

The changeover valve 100 is enabled to move a spool 104 rightward of FIG. 1 against the action of a coil spring 105 by energizing a solenoid 103. The changeover valve 100 is so constructed as to establish, when deenergized, the communication between a feed port 106, as connected to an oil pump (not shown) to be driven by the internal combustion engine, and the connection port 101 and the communication between the connection port 102 and exhaust port 107 and as to establish, when energized, the communication between the feed port 106 and the connection port 102 and the communication between the connection port 101 and an exhaust port 108. As a result, the working oil is fed to the delay passage 11 when the solenoid 103 is deenergized, and to the advance passage 12 when the same is energized.

The internal rotor 20 is integrally fixed in the cam shaft 10 by means of a hollow bolt 16 and is provided with vane grooves 21 for providing the six vanes 70 individually in the radial direction. Further provided are passages 22 for feeding/discharging the working oil to and from delaying chambers R2 and passages 23, which includes an annular passage 15a connected to the advance passage 12 and six passages 23 extended in the radial direction of the cam shaft 10, for feeding/discharging the working oil to and from advancing chambers Rl. Here, each vane 70 is urged radially outward by a spring 71 (shown in FIG. 1) fitted in the bottom portion of the vane groove 21.

In the inner circumference of the external rotor 30, the external rotor 30 is so assembled with the outer circumference of the internal rotor 20 as to rotate relative thereto within a predetermined range. To the two sides of the external rotor 30, the front plate 40 and the rear plate are joined through seam members SI and S2. The external rotor 30 is integrally joined to the internal rotor 20 together with the timing pulley 60 by means of six bolts B1. With the front plate 40, there is assembled liquid-tight the cap 41 to form a passage 42 for connecting the delaying passage 11 of the cam shaft 10 and the passages 22 of the internal rotor 20. In the external rotor 30 (shown in FIG. 2, there are six concave portions 32 which form a fluid pressure chamber ROI and five fluid pressure chambers R0 accommodating the individual vanes 70 and adapted to be separated into the advancing chambers R1 and the delaying chambers R2; and six projections 31 located between the neighbor concave portions 32.

Figure 3:
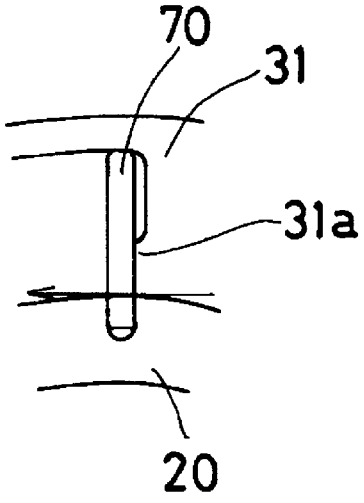
FIG. 3 is a sectional view, on an enlarged scale, of a portion of a stopper seen in FIG. 2 in accordance with the present invention.

In a preferred embodiment, as shown in FIG. 2, the width in the circumference direction of the fluid pressure chamber R01 is smaller than the same of the fluid pressure chamber R0. There are stoppers 31*a* and 31*b* on both opposite end walls of the fluid pressure chamber R01. As shown in FIG. 3, each stopper 31*a* and 31*b* is located on the top portion of the end wall, respectively. Thus, at a bottom portion of the vane 70, the vane 70 which is disposed within the fluid pressure chamber R01 is able to contact with the stoppers 31*a* and 31*b*. Accordingly, the relative rotation between the cam shaft 10 and the timing pulley 60 is controlled by the stoppers 31*a* and 31*b*. Further, when the vane 70 in the fluid pressure chamber R01 contacts with the stopper 31*a*, there are spaces 71 in each fluid pressure chamber R0. The space 71 is formed between the vane 70 in the fluid pressure chambers R0 and the end wall of the fluid pressure chamber R0.

On the outer circumference of the external rotor 30, as shown in FIG. 2, there are six projections 33 extending outwardly to receive the bolt B1. In the inner circumference of the timing pulley 60, there are six projections 60*a* which are engaged with the projections 33 of the external rotor 30, respectively. There are six cavities which are thereby disposed between the outer circumference of the external rotor 30 and the inner circumference of the timing pulley 60.

In the above preferred embodiment of the present invention, as the changeover valve 100 is controlled by the fluid under pressure of the advancing chambers R1 and the delaying chambers R2, the valve timing control device is variable from the most advancing condition to the most delaying condition. In the most advancing condition, as shown in FIG. 2, the vane 70 in the fluid pressure chamber R01 contacts with the stopper 31*a* and the spaces 71 are formed between the vanes 70 in the fluid pressure chambers R0 and the end walls in the delaying chambers R2. In the most delaying condition, on the other hand, the vane 70 in the fluid pressure chamber R01 contacts with the stopper 31*b* and the spaces 71 are formed between the vanes 70 in the fluid pressure chambers R0 and the end walls in the advancing chambers R1.

Figure 4:
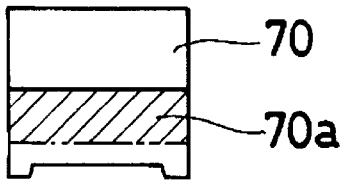
FIG. 4 is a detailed view of a vane in accordance with the present invention.

The relative rotation between the cam shaft 10 and the timing pulley 60 is controlled by one vane 70 in the fluid pressure chamber R01 contacting with either the stopper 31*a* or 31*b*, such that the relative positions between the other vanes 70 in the fluid pressure chambers R0 and the fluid pressure chambers R0 are not necessarily in the same relative positions. Here, although the vane 70 in the fluid pressure chamber R01 receives both the variable torque of the cam shaft 10 and the rotational torque to rotate the cam shaft 10, both the stoppers 31*a* and 31*b* are located at the top portion of the side walls of the concave portion 32 so that this kind of the torque is received at a torque receiving portion 70*a* of the vane 70 as shown in FIG. 4. The shearing load acts to the vane 70 as shown in FIG. 3. Thereby, the strength of the vane 70 is remarkably increased in comparison with the stoppers 31*a* and 31*b* which are located at the bottom portion of the side walls of the concave portion 32. A test by the inventors showed the breaking torque of the vane 70 increased from 178 N.m to 374 N.m.

Figure 5:
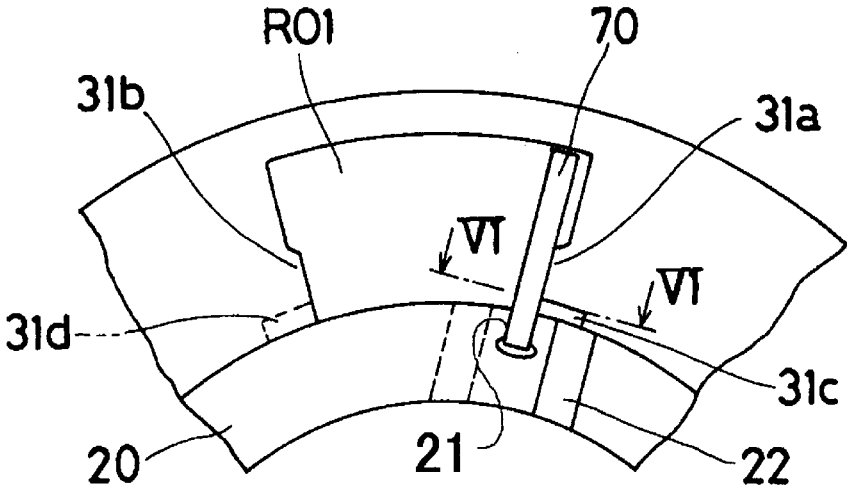
FIG. 5 is a view similar to FIG. 3, showing still another modification in accordance with the present invention.
Figure 6:
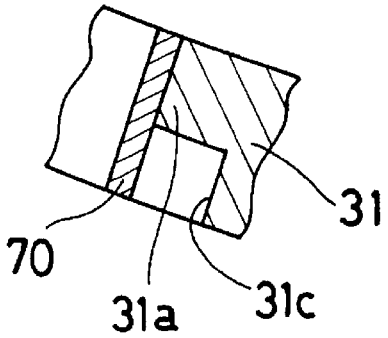
FIG. 6 is a sectional view taken along the line VI—VI in FIG. 5 in accordance with the present invention.

FIGS. 5 and 6 illustrate another modified version of the first preferred embodiment, which specifically is a modified arrangement of the stoppers 31*a* and 31*b*. In FIG. 5, the same parts as shown in FIGS. 2 and 3 are indicated by the same numerals of FIGS. 2 and 3. In this modified construction, a valve timing control device further includes two connecting passages 31*c* and 31*d* which are located between the outer circumference of the internal rotor 20 and the inside end of the stoppers 31*a* and 31*b*. The connecting passage 31*c* is communicated between the passage 22 and the torque receiving portion 70*a* of the vane 70 when the vane 70 contacts with the stopper 31*a*. On the other hand, the connecting passage 31*d* is communicated between the passage 23 and the torque receiving portion 70*a* of the vane 70 when the vane 70 contacts with the stopper 31*b*. When the valve timing control device changes the relative rotational position from the most advancing/delaying position to the most delaying/advancing position, the fluid under pressure acts to the vane 70 in the fluid pressure chamber R01 at the most advancing/delaying position. As a result, the response of the valve timing control device is very quick.

Figure 7:
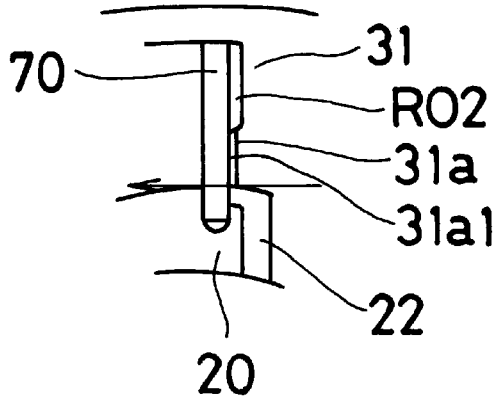
FIG. 7 is a view similar to FIG. 5, showing still another modification in accordance with the present invention.
Figure 8:
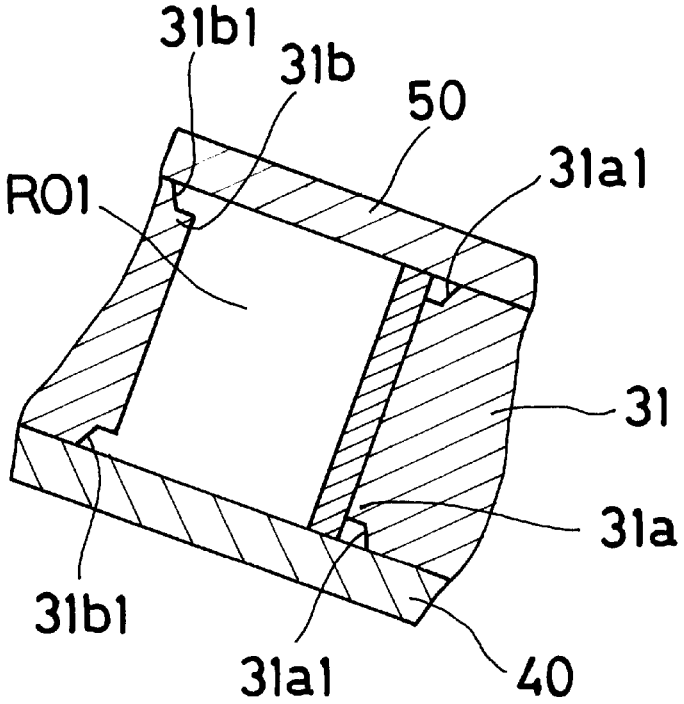
FIG. 8 is a view similar to FIG. 6 in accordance with the present invention.

FIGS. 7 and 8 illustrate the other modified version of the first preferred embodiment, which specifically is a modified arrangement of the stoppers 31*a* and 31*b*. In FIG. 7, the same parts as shown in FIGS. 2 and 3 are indicated by the same numerals of FIGS. 2 and 3. In this modified construction, a valve timing control device further includes four connecting passages 31*a*1 and 31*b*1 which are located on the stoppers 31*a* and 31*b* in parallel with the vane 70. The connecting passages 31*a*1 are communicated between the passage 22 and a space R02, when the vane 70 contacts with the stopper 31*a*. The space R02 is formed between the vane 70 and the projection 31 of the external rotor 30. When the valve timing control device changes the relative rotational position from the most advancing/delaying position to the most delaying/advancing position, the fluid under pressure acts to the vane 70 in the fluid pressure chamber R01 at the most advancing/delaying position. As a result, the response of the valve timing control device is very quick.

While the invention has been described in conjunction with one of its preferred embodiments, it should be understood that changes and modifications may be made without departing from the scope and spirit of the appended claims.

What is claimed is:

1. A valve timing control device comprising:

a rotor fixed on a cam shaft of an engine;

a rotational transmitting member having a plurality of concave portions located on an inner circumferential surface thereof, the rotational transmitting member being mounted around the outer circumferential surface of the rotor so as to rotate relative thereto within a predetermined range for transmitting rotational power from a crank shaft;

fluid chambers defined between the rotor and the rotational transmitting member, each of the fluid chambers having a pair of circumferentially opposing walls;

a plurality of plate shaped vanes mounted on the outer circumferential surface of the rotor and extending outwardly therefrom in the radial direction into the fluid chambers so as to divide each of the fluid chambers into an advancing chamber and a delaying chamber;

a plurality of grooves positioned on the outer circumferential surface of the rotor so as to extend in the radial direction, wherein each one of said grooves accommodates one of said vanes so that said each vane is able to move in the radial direction;

a fluid supplying means for supplying fluid under pressure to at least a selected one of the advancing chambers and the delaying chambers; and a stopper formed on a radial inner end portion of at least one of the opposing walls which is adjacent to the inner circumferential surface of the rotational transmitting member so as to abut a base portion of the vane adjacent to the outer circumferential surface of the rotor to restrict relative rotation between the rotational transmitting member and the rotor.

2. The valve timing control device as claimed in claim 1 wherein the stopper includes a fluid passage along the opposing wall.

* * * * *